United States Patent [19]

Daigle

[11] 4,329,892

[45] May 18, 1982

[54] SHOCK-SOCKET

[76] Inventor: Vincent J. Daigle, 115 Sickle St., Chatham, New Brunswick, Canada, E1N 2B9

[21] Appl. No.: 184,899

[22] Filed: Sep. 8, 1980

[51] Int. Cl.[3] ..... B25B 17/00

[52] U.S. Cl. ..... 81/55

[58] Field of Search ..... 81/55, 56

[56] References Cited

U.S. PATENT DOCUMENTS

| | | | |
|---|---|---|---|
| 3,889,558 | 6/1975 | Duncan | 81/55 |
| 3,916,734 | 11/1975 | Sawan | 81/55 |
| 3,935,760 | 2/1976 | Taylor | 81/55 |

*Primary Examiner*—James L. Jones, Jr.
*Attorney, Agent, or Firm*—Ralph J. Broderick

[57] ABSTRACT

This invention is a unique mechanical combination devised to effect the rapid and efficient removal and replacement of the upper nut on the stem of the front shock-absorbers used in motor-vehicles. A round member, having a squared top, is scored in two places on the circumference thereof, which scores are adapted to receive and hold two snap-rings. The bottom part of the round member is relatively larger in exterior diameter than the body thereof and is interiorly oblongularly hollowed to fit over and to hold the stem of the shock-absorber. The round member with one snap-ring attached is adapted to be placed inside of and to move up and down in, a hollow cylindrical member for a distance governed by the position of the other snap-ring. The hollow cylindrical member has an exteriorly hexagonal hollow top section, the interior diameter of which is fractionally larger than the exterior diameter of the body of the round member and which holds the round member in movable working positions. The squared end of the round member, in place in the cylindrical member, is adapted to be held by a T-shaped handle, with an interiorly squared tail, by set-screw means in the tail of the handle. The cylindrical member has another section directly under the hexagonal top section, which is relatively larger in diameter than the top section. The bottom section of the cylindrical member is relatively smaller in exterior diameter than the diameter of the body of the cylindrical member and the bottom section is interiorly ridged to form an interior hexagon, designed to receive and hold the upper nut of a front shock-absorber.

1 Claim, 10 Drawing Figures

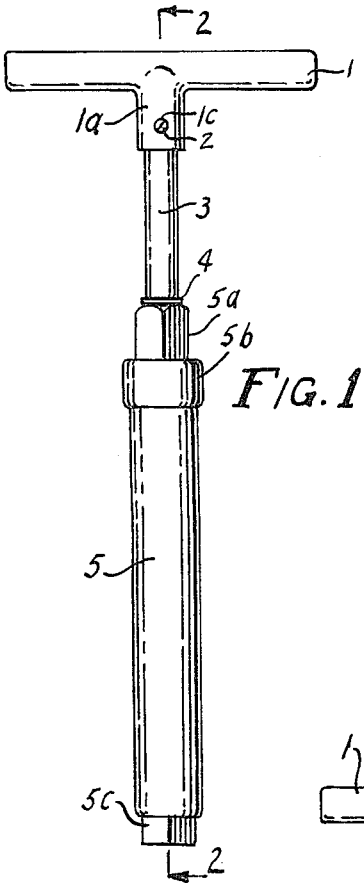
FIG. 1
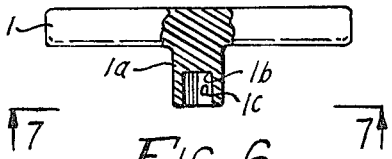
FIG. 6
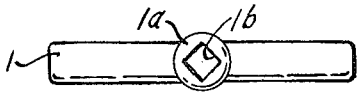
FIG. 7
FIG. 10
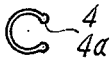
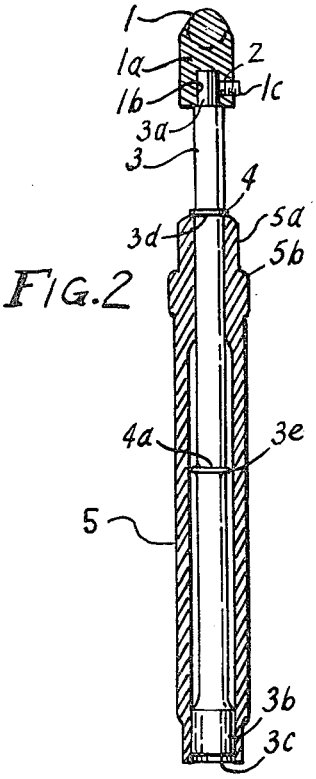
FIG. 2
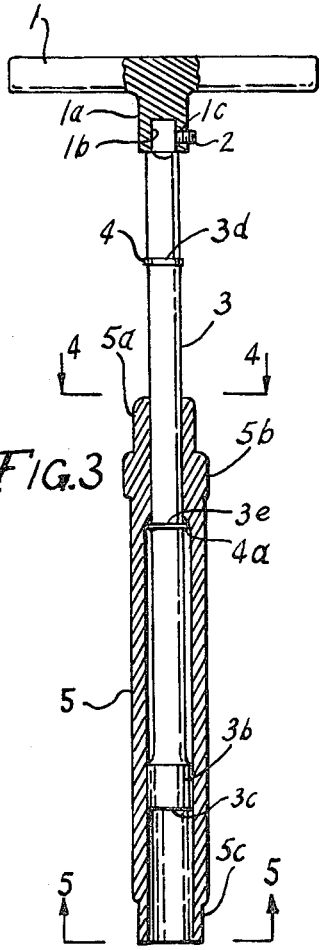
FIG. 3
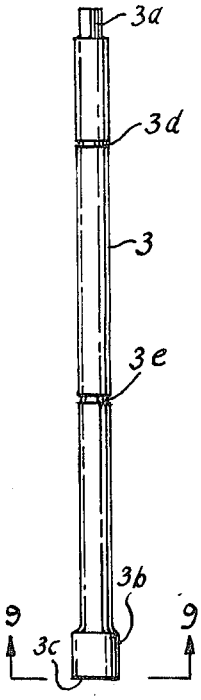
FIG. 8
FIG. 9
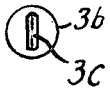
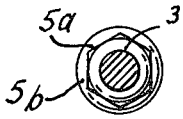
FIG. 4
FIG. 5
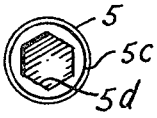

SHOCK-SOCKET

This invention is a unique mechanical combination which is entirely novel and is devised as a new means for the removal and replacement of the upper nut on the stem of the front shock-absorbers used in all conventional motor-vehicles.

It has been the experience of mechanics and service station and garage operators engaged in the repair and maintenance of motor-vehicles, that it normally takes from 10 to 30 minutes to remove or install the upper nut on the stem of the front shock-absorbers used in motor-vehicles, as these shock-absorbers are generally located and installed in a relatively inaccessible section of the motor-vehicle, which results in difficulty in the removal and installation of same and which, in turn, results in loss of time and in increased labour costs.

My invention makes it possible to remove or install the upper nut on said front shock-absorbers in less than 60 seconds.

It is thus an improvement over the presently known art, in that it is a time and labour saving device of great service in the motor-vehicle industry and is thus of genuine public interest and is a benefit to the economy generally.

My invention is simpler to produce and less costly to manufacture, than the means presently used to achieve the same purposes.

In the drawings which illustrate the embodiments of this invention and in which the same numbers are used to indicate the same parts:

FIG. 1 illustrates a perspective view of this invention, with all its parts combined.

FIG. 2 is a sectional side view of the device, taken on line 2—2 of FIG. 1.

FIG. 3 is a sectional front view of the device similar to FIG. 2, with the device in a position preparatory to use.

FIG. 4 is a sectional view of the device taken on the line 4—4 of FIG. 3.

FIG. 5 is a bottom view of the device taken on the line 5—5 of FIG. 4.

FIG. 6 is a plan view of the handle portion, partly in section.

FIG. 7 is a bottom view of the device's handle portion, taken on the line 7—7 of FIG. 6.

FIG. 8 is a plan view of the round metallic member.

FIG. 9 is a bottom view of the round metallic member taken on the line 9—9 of FIG. 8.

FIG. 10 is a plan view of the snap ring.

In the drawings the number 1 indicates a T-shaped solid handle having a truncated tail 1*a*, made of circular pieces of metal welded together, the handle 1 is interiorly provided in its truncated tail 1*a*, with a squared aperture 1*b*, FIG. 2. The tail 1*a* is further provided with a threaded aperture 1*c* in one side, this aperture 1*c* is designed to receive and hold a set screw 2, FIG. 3, (use position).

The number 3, FIG. 2, indicates a unitary solid round metallic member having one end squared 3*a*, and having its outer end 3*b*, relatively larger in diameter than the round member 3, the end 3*b* being oblongularly hollowed with rounded corners 3*c*, FIG. 2, on the inside of its larger end 3*b*.

The body of the round member 3 is provided with two circular indented scores 3*d* and 3*e*, disposed and adapted to receive two snap rings 4 and 4*a*, FIGS. 1, 2 and 3.

The number 5, FIGS. 1, 2 and 3, indicates a unitary, hollow, round, metallic cylindrical member, hereafter called the cylinder 5, having a circularly hollow top section 5*a*, FIG. 2, which top section 5*a* is exteriorly hexagonal in configuration, FIGS. 1 and 2, and is designed to receive and hold a wrench and having a section 5*b*, FIGS. 1, 2 and 3, relatively larger in exterior diameter than the cylinder 5, and situated under the hexagonal end 5*a*, this section 5*b* is designed to prevent a wrench from slipping down. The cylinder 5 is provided with a bottom section 5*c*, FIG. 2, relatively smaller in interior and exterior diameter than the interior and exterior diameter of the body of the cylinder 5, this bottom section 5*c* is interiorly provided with ridges, forming therein an interior hexagon 5*d*, FIG. 2. The hollow top section 5*a*, FIG. 2, is relatively smaller in interior diameter than the interior diameter of the body of the cylinder 5 FIG. 3, both views, and the interior diameter of section 5*a* is fractionally larger than the exterior diameter of the round member 3 and is designed to receive and movably hold the round member 3 and to allow the round member 3 to move freely up and down in the cylinder 5, FIG. 3, for a distance governed by the position of the snap rings 4 and 4*a*, installed in the two circular scores 3*d* and 3*e* in the body of the round member 3, FIG. 3, (both views).

The mode of use and operation of this invention is as follows:

Install the first snap ring 4*a* in score 3*e*, in the solid round member 3, FIG. 2, then push round member 3 into the hollow cylindrical member 5 from the bottom, until the score 3*d* on the round member 3, is above the top of cylinder 5 and then install the second snap ring 4 in the score 3*d*, in the solid round member 3, FIG. 3.

Then the T-shaped handle 1 is installed by placing the rectangularly hollowed aperture 1*b*, FIG. 2, in its tail 1*a*, over the squared end 3*a* of the round member 3 and pushing same down over the squared end 3*a*, of round member 3, FIG. 2. The set screw 2 is then screwed into the threaded aperture 1*c* in tail 1*a* of the handle 1, and is tightened against the squared end 3*a* of the round member 3, until the handle 1 is securely held on the top 3*a* of the solid round member 3, FIG. 3, (use position).

The invention is then ready to be used as follows:

The interiorly hexagonal bottom section 5*d* of the cylinder 5, FIG. 2, is placed over the upper nut of a front shock-absorber. The oblongularly hollow end 3*c* of the bottom section of the round member 3 is manually pushed down by the handle 1, over the stem of the shock-absorber, the handle 1 being attached to the round member 3 as described, the oblongularly hollow end 3*c*, FIG. 2, of round member 3 holds the shock-absorber stem from turning; the handle is held by one hand during this process.

With the other hand, an open-end wrench is then placed around the hexagonal top section 5*a* of the outer cylinder 5, FIGS. 1, 2 and 3, and the wrench is turned, which results in turning the outer cylinder 5, then holding the nut of the shock-absorber as described, which very quickly turns the nut off of the shock-absorber and allows the shock-absorber to be removed, repaired or replaced.

The process may be used to install the upper nut on the shock-absorber by placing the nut in the interiorly hexagonal part 5*d*, FIG. 2, of cylinder 5 and pressing the handle 1 down which results in the oblongularly hollowed section 3*c*, FIG. 2, of the round member 3 holding the stem of the shock-absorber and then tightening the nut by turning the top 5*a*, FIGS. 1, 2 and 3, of the cylinder 5, with the wrench as described, until the nut is tightly held on the shock-absorber.

The above disclosure and specification embodies my invention and discovery and all matters contained therein should be deemed to be illustrative and not to be in a limiting sense.

As this invention may be embodied in forms other than, or varying from, my invention, I claim as my invention and discovery all the forms of same which may be deemed to fall within the spirit and scope of my appended claims.

Having described my invention, I hereby particularly point out and distinctly claim and desire to secure by Letters Patent the following parts, improvements, articles and combinations as my invention and discovery:

1. A mechanical combination consisting of a solid handle combined in the center thereof with a truncated tail by weld means, to form a truncated T-shaped unit, the truncated tail being provided with a squared aperture in the end thereof and being further provided with a threaded aperture in one side thereof, the said aperture being adapted and designed to receive and hold a conventional set-screw, the handle is combined by set-screw means with a unitary solid round member, one end of which is squared to fit into the squared aperture in the tail of the handle and the other end of which is rounded and relatively larger in diameter than the body of the above described round member, the said rounded end being oblongularly hollowed in the interior thereof, the hollowed interior having rounded corners in order to fit over the stem of a conventional shock-absorber, the said round member is provided with two circular indented scores, these scores are each disposed and adapted to receive a conventional snap-ring, the said round member is disposed and adapted to be placed inside a unitary hollow round cylindrical member and to be held in a movable position therein by the said snap rings on the round member, the said unitary hollow round cylindrical member has one end thereof exteriorly hexagonal in shape and the interior diameter of this end is fractionally larger in diameter than the exterior diameter of the round member and permits the round member to move freely upward and downward therein for a distance controlled by distance between the said snap-rings on the round member, immediately under the exteriorly hexagonal section of the cylindrical member there is another section of the cylindrical member, relatively larger in exterior diameter than the hexagonal section, the cylindrical member has at its bottom end a section which is relatively smaller in its exterior and interior diameters than the body of the cylindrical member, this latter section of the cylindrical member is interiorly provided with ridges disposed and adapted to form a hexagonal section in the interior thereof, the hexagonal section is disposed and adapted to receive and hold the nut on the stem of a conventional shock-absorber.

* * * * *